US005485685A

United States Patent [19]

Hashimoto

[11] Patent Number: 5,485,685

[45] Date of Patent: Jan. 23, 1996

[54] WOOD TREATING METHOD

[75] Inventor: Yotaro Hashimoto, Shiga, Japan

[73] Assignee: Eiwa Co., Ltd., Shiga, Japan

[21] Appl. No.: 328,383

[22] Filed: Oct. 24, 1994

Related U.S. Application Data

[63] Continuation of Ser. No. 33,155, Mar. 16, 1993, abandoned.

[30] Foreign Application Priority Data

Apr. 10, 1992 [JP] Japan ..... 4-089198
Dec. 22, 1992 [JP] Japan ..... 4-342513

[51] Int. Cl.[6] ..... F26B 3/00

[52] U.S. Cl. ..... 34/348; 34/351; 34/415; 8/402

[58] Field of Search ..... 34/337, 340, 348, 34/351, 343, 404, 409, 415, 218; 427/335, 351; 144/271; 117/63, 147; 8/402

[56] References Cited

U.S. PATENT DOCUMENTS

| | | | |
|---|---|---|---|
| 2,435,219 | 9/1947 | Hudson | 117/57 |
| 2,650,885 | 6/1950 | Hudson | 117/63 |
| 3,900,615 | 7/1975 | Dunn, Jr. | 427/317 |
| 3,948,802 | 4/1976 | Lidell | 252/404 |
| 3,959,529 | 5/1976 | Winn et al. | 427/335 |
| 3,967,011 | 6/1976 | Dunn, Jr. et al. | 427/345 |
| 4,567,115 | 1/1986 | Trumble | 428/541 |

FOREIGN PATENT DOCUMENTS

| | | |
|---|---|---|
| 49-116204 | 11/1974 | Japan . |
| 51-136803 | 11/1976 | Japan . |
| 61-37402 | 2/1986 | Japan . |
| 1-38641 | 8/1989 | Japan . |

*Primary Examiner*—Denise L. Gromada
*Attorney, Agent, or Firm*—Knobbe, Martens, Olson & Bear

[57] ABSTRACT

There are available as chlorine base organic solvents for cleaning by vapor-defatting methylene chloride ($CH_2Cl_2$), trichloro ethylene ($CHCl{=}CCl_2$), perchloroethylene ($CCl_2{=}CCl_2$), 1,1,1-trichloroethane ($CH_3CCl_3$) and flon 113 ($CCl_2FCClF_2$), etc., of which mainly used is a methylene chloride ($CH_2Cl_2$) solvent. By vaporizing said methylene chloride solvent and permeating its vapor into the wood to be treated 10, to melt the tough lignin in the cell structure, thereby perforating the cell membranes, and undermine the valve action of portholes of the false vessels or vessels, fleeing of the cell water confined inside the cells and lumens is facilitated through said perforations and the porthole valves. By perforating the cells and undermining the valve action of the portholes, the fleeing of the free water confined therein, when drying the treated wood by hot air or sun's heat, is facilitated, for the benefit of very rapid drying. Besides, easy penetration of fine dye grains into the wood through said perforations and portholes enables its coloration to deep layers of wood.

4 Claims, 6 Drawing Sheets

WOOD TREATING METHOD

This application is a continuation of U.S. application Ser. No. 08/033,155 filed Mar. 16, 1993, now abandoned.

FIELD OF THE INVENTION

The present invention relates to a method for defatting, coloring and drying wood. By the conventional method for treating wood by defatting, drying and coloring and so forth, such parts of wood as cellulose, hemicellulose and lignin, which compose its cell membranes, can hardly be melted out in any way. If excess water in wood were tried to be abruptly evaporated in a short time, the shape of wood would be notably altered, so that it became unsuitable to be processed into the designated wood products.

Therefore, it was only possible to perform this treatment by drying wood, taking such a long time as about one year and with care not to alter the shape of wood. Enormous energy and time are expended for the work of drying wood, so that the quantity of treatable products is naturally limited. Such other many problems have arisen. Lignin itself is a material which was difficult to decompose or dissolve, its composition being not chemically clarified. When coloring wood, the dye permeates only to its thin surface layer.

Thus whether wood is dried by the sun's heat or artificially, reducing the water content of wood to the saturation point of fibers can relatively easily be done by removing free water which is not confiend in cells, but the free water confined in the cell membranes, which are tightly closed by lignin being a chemical component with high molecular phenols as its basic component material, can hardly be removed.

As a tree has been felled, the poreholes of the false vessels and vessels of wood close, as if acting as valves, whereby the free water is confined within them. If the surface is abruptly dried, while drying wood, the aforementioned poreholes of the false vessels and vessels close, acting as valves, whereby movement of free water content in lumens is stopped, bringing about a state in which the moisture remaining in the lumens do not evaporate, however high the temperature is raised thereafter, a surface hardened state.

As above-described, the wood, after the parent tree has been felled, performs the act of confining water content in its cells and lumens by means of lignin, etc. Accordingly, its water content can hardly be evaporated by drying by sun's heat or hot air, thus requiring long time for its drying.

In contrast, according to this invention, in order to draw out water content from the cell membranes firmly blocked by lignin, the unconfined free water is removed at first by blowing the wood with the vapor pressurized by heating of a chlorine base organic solvent for cleaning by vapor-defatting like a methylene chloride ($CH_2Cl_2$) solvent and thereafter, the fine molecules of the vapor of the methylene chloride ($CH_2Cl_2$) solvent melts the tough lignin in the cell structure, thereby to perforate the cell membranes and undermine the valve action of the portholes. In that way, fleeing to outside of the free water confined within through said perforations of the cells and said porthole valve parts is facilitated.

The perforations of the cells and the collapse of the valve action of the portholes permit fine molecules of a dye to easily penetrate into the cell membranes, thereby enabling easy coloration deep into the interior of wood.

PRIOR ART

Heretofore, the techniques for subjecting wood to special treatments for improvements in putrefaction resistance, durability and designability, etc., while maintaining the proper properties of wood, are believed to be well known. They include such techniques as appear in Japanese Patent Laid-Open Nos. Sho 49-116204, 51-136803 and 61-37402 and Japanese Patent Publication No. Hei 1-38641.

SUMMARY OF THE INVENTION

The problem the present invention is to solve is as above-described. In the following, a means to solve said problem is defined. Thus in the wood treating work, a chlorine base organic solvent for cleaning by vapor-defatting is vaporized by heating said solvent to boil, to permeate its gas into the wood, thereby melting its oil and fat contents and consequently perforating its cell membranes.

The present invention provides a wood treating method which comprises adding water to a chlorine base organic solvent for cleaning by vapor-defating and then heating the mixture to from about 100°–130° C., to permeate steam and vapor of the chlorine base organic solvent for cleaning by vapor-defatting into the wood, thereby melting its oil and fat contents and consequently perforating its cell membranes, in the wood treating process.

It also provides a wood treating method which comprises hermetically sealing wood and a chlorine base organic solvent for cleaning by vapor-defatting in a pressure container, to respectively subject them to compression by heating and decompression by cooling, thereby promoting the melting of the oil and fat components of the wood by the chlorine base organic solvent for cleaning by vapor-defatting, in the wood treating process.

The wood treating method further comprises drying the treated wood.

The wood treating method still further comprises coloring wood by permeating a fine grained dye thereinto.

DESCRIPTION OF A PREFERRED EMBODIMENT

Figure 1:
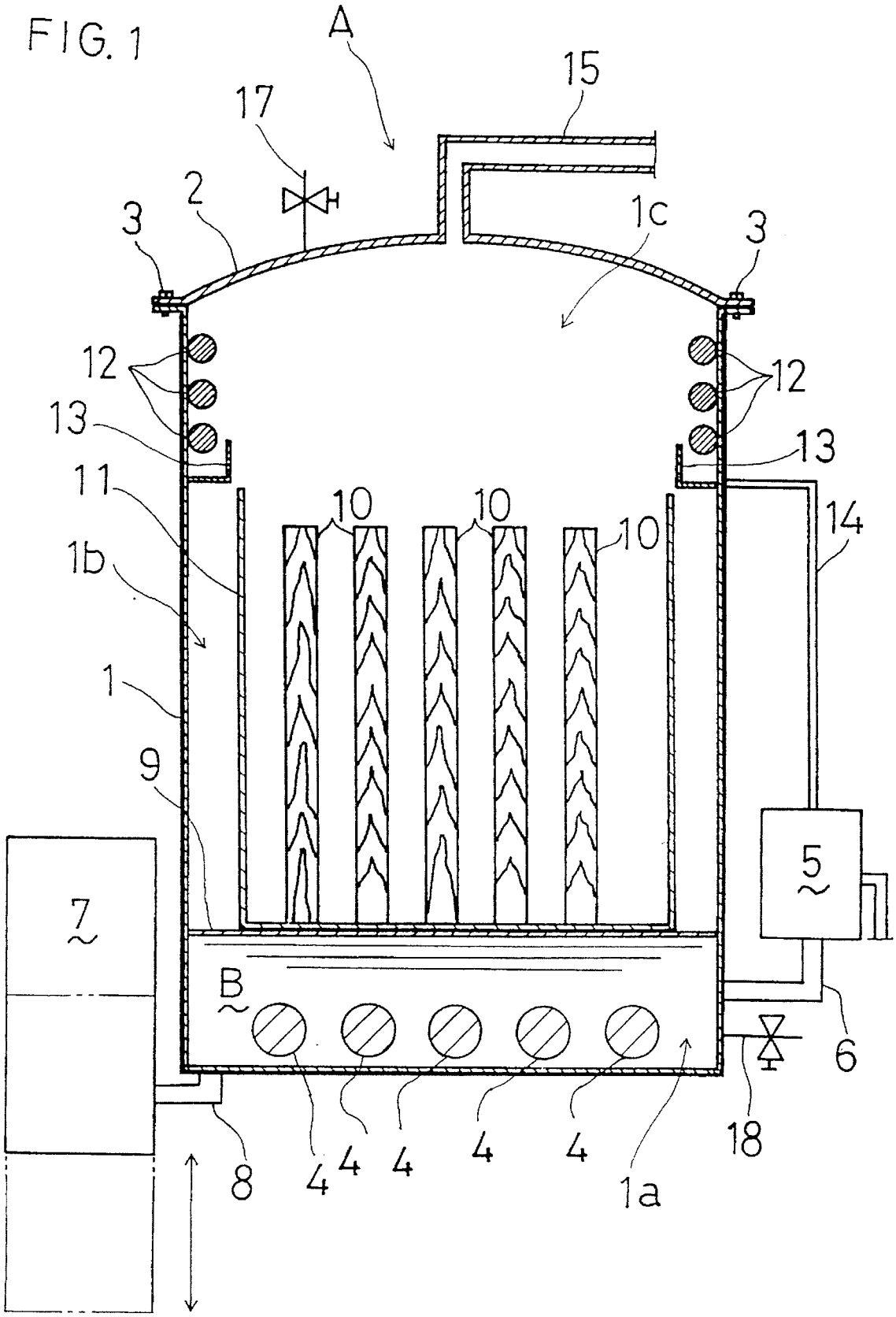
FIG. 1 is a front sectional view of a treating apparatus for use in exercising the wood treating method of this invention.
Figure 2:
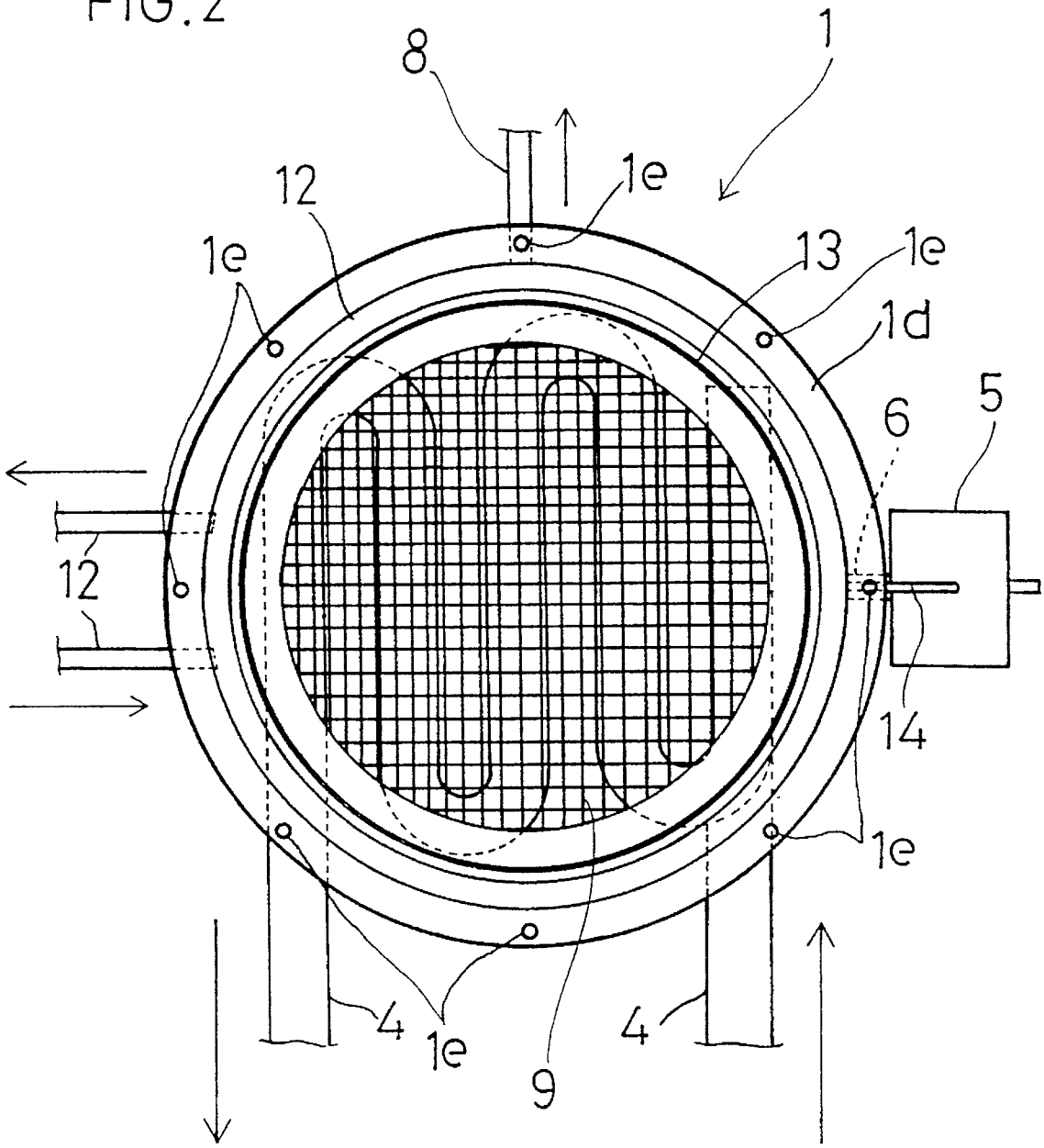
FIG. 2 is a plan view of the treating apparatus with its top cover removed for use in exercising the wood treating method of this invention.

In reference to FIGS. 1 and 2, the composition of the treating apparatus for use in exercising the treating method of this invention is described. A wood treating pressure container A is made of stainless steel and is composed of a cylindrical body 1 and a dome shape top cover 2 placed thereon, said dome shape top cover 2 being mounted on the body 1 by screwing a plurality of closing bolts into a plurality of bolt holes 1*e*, 1*e*, . . . of a flange 1*d* located at the top of the body 1, and further the inside of the body 1 being composed of 3 compartments of a solvent tank 1*a*, a treating chamber 1*b* and a cooling chamber 1*c*.

The aforementioned solvent tank 1*a* is, as shown in FIGS. 1 and 2, arranged under a floor of the body 1 and is fully filled with a methylene chloride solvent B, being a chlorine base organic solvent for cleaning by vapor-defatting. As other organic solvents than methylene chloride ($CH_2Cl_2$) for cleaning by vapor-defatting, there are available trichloroethylene ($CHCl{=}CCl_2$), perchloroethylene ($CCl_2{=}CCl_2$), 1,1,1-trichloroethane ($CH_3CCl_3$) and flon 113 ($CCl_2FCClF_2$), etc. In this embodiment, the methylene chloride ($CH_2Cl_2$) solvent B is used. A heat supply pipe 4 for heating said methylene chloride solvent B to boil is arranged from outside the tank for uniformly warming the whole of the tank interior. Besides, there are respectively connected to the solvent tank 1*a* a solvent return pipe 6 for returning into the solvent tank 1*a* the methylene chloride solvent B, which has been recovered by distillation at the cooling chamber 1*c* and then refined in a water separator 5, and a solvent drain pipe 8 for draining the methylene chloride solvent B out of the solvent tank 1*a* after accomplishment of the first half of the treating operation, to store it in a solvent storage tank 7.

The aforementioned solvent tank 1*a* and the treating chamber 1*b* are partitioned by a drainboard floor 9. Inside said treating chamber 1*b*, the vapor of the methylene chloride solvent B which has been heated to boil at such a low temperature as about 40° C. in the solvent tank 1*a* is accumulated, forming a solvent vapor layer C of methylene chloride. During the treating operation, a highly ventilative wood transport container 11 holding wood blocks to be treated 10 is mounted on the drainboard floor 9 of the treating chamber 1*b*. The methylene chloride ($CH_2Cl_2$) solvent B, which boils at about 40° C., may be readily vaporized and this vapor has the effect of defatting the oil and fat components of wood.

The cooling chamber 1*c* provided in such a way as to form a border D between air/vapor over the aforementioned treating chamber 1*b* is designed to recover by distillation the excess solvent vapor which has come up from the treating chamber 1*b*. It is so composed that with the temperature of said cooling chamber 1*c* always preset not higher than 40° C., the B.P. of the methylene chloride solvent B, by means of cooling water, the vapor of the methylene chloride ($CH_2Cl_2$) solvent B coming up from the treating chamber 1*b* condenses there, accumulates in a condensate and water receiving trough 13, is then fed through a condensate pipe to a water separator installed on one side of the body 1, to be refined, and returned to the solvent tank 1*a*.

Figure 3:
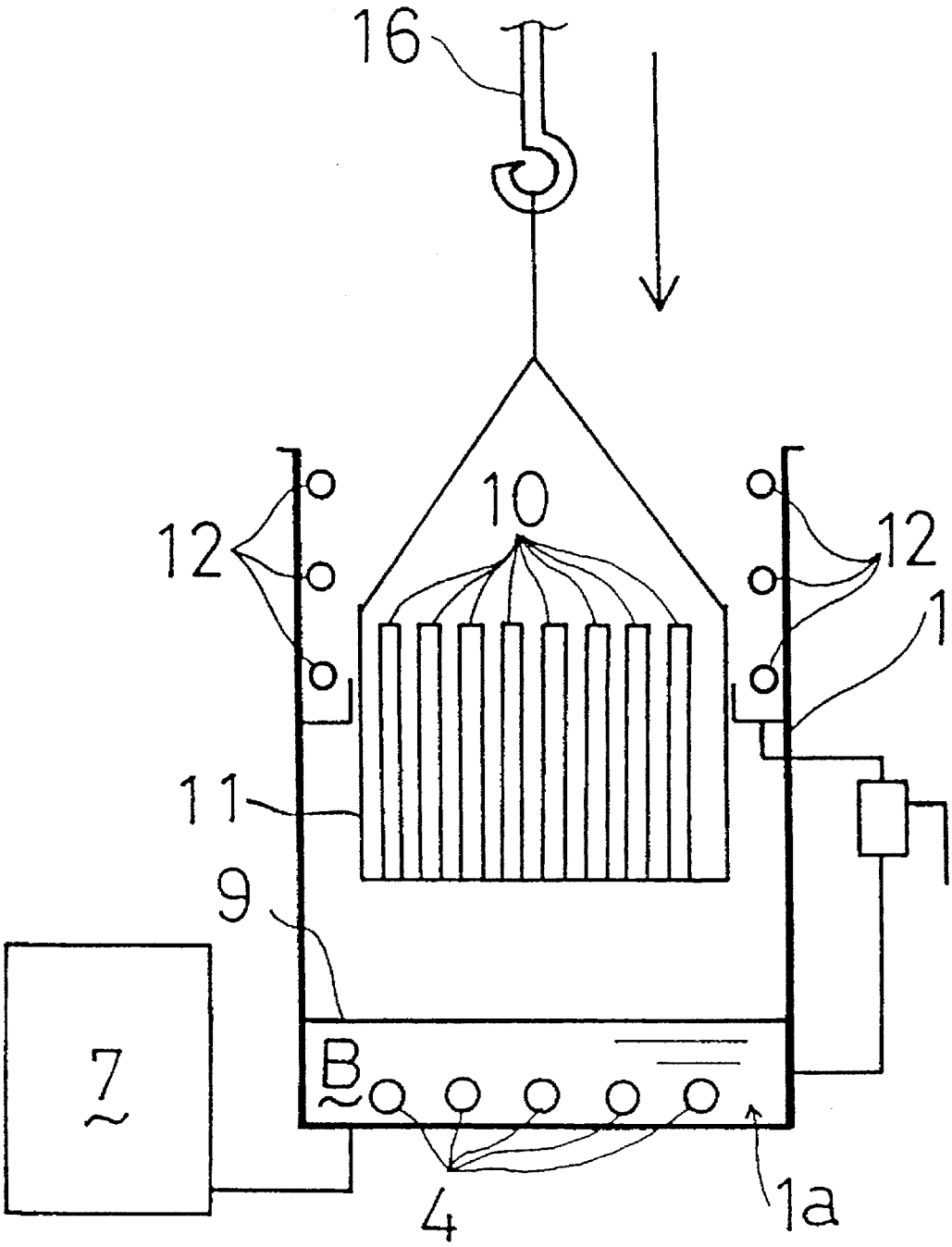
FIG. 3 is a schematic sectional view of the treating apparatus for use in exercising the wood treating method of this invention, showing its preparation for the treating work by use thereof.

Referring to FIGS. 3 to 6, the treating work of this invention is described hereunder: First, as shown in FIG. 3, a wood transport container 11 holding the wood blocks to be treated 10 is carried in by a crane 16, to be mounted on the drainboard floor 9 inside the apparatus body I in the state of the cover 2 of the wood treating pressure container A being taken off.

Figure 4:
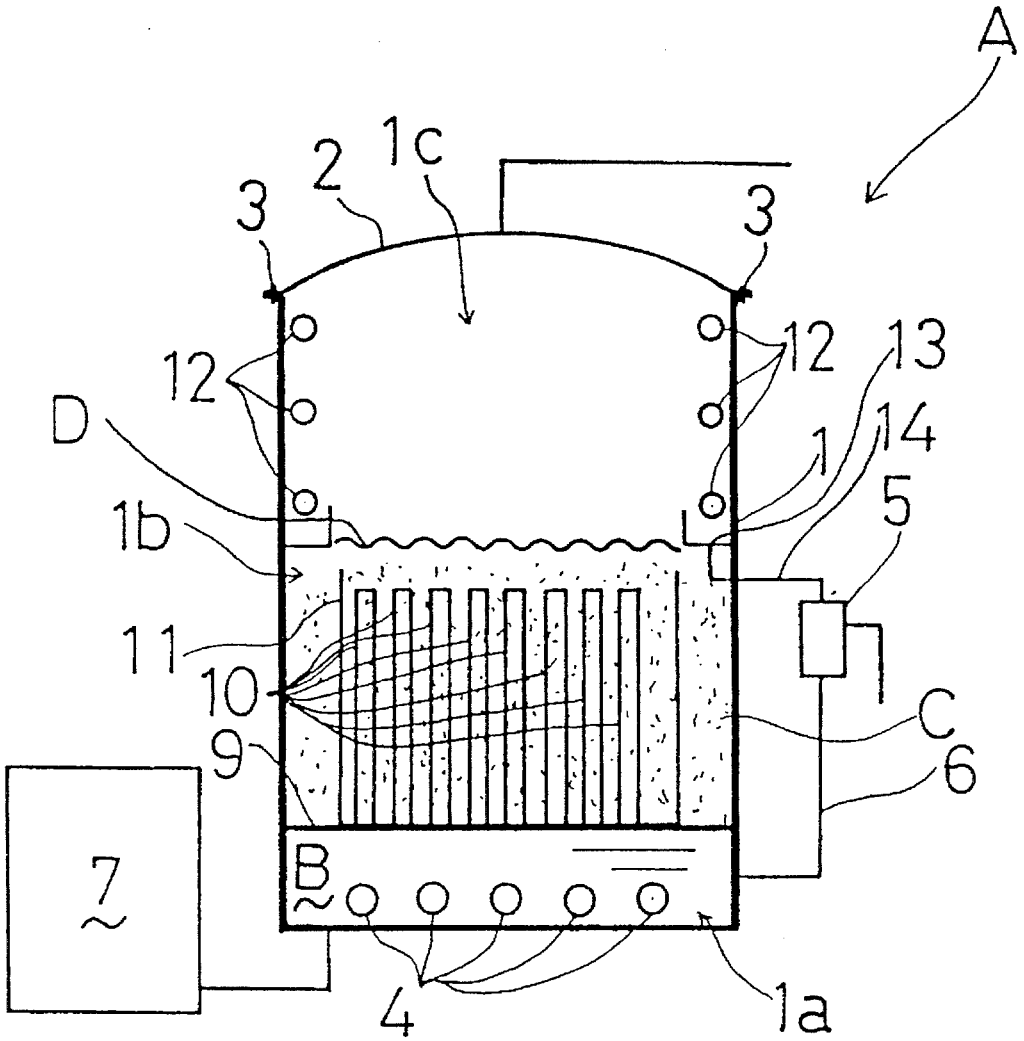
FIG. 4 is a schematic sectional view of the treating apparatus for use in exercising the wood treating method of this invention, showing the treating work by use thereof.

Then as shown in FIG. 4, the top cover 2 is screw-fitted to the body by closing bolts, 3, 3, . . . , to hermetically seal the interior of the wood treating pressure container A. As the power switch for the heat supply pipe 4 is turned ON, the heat from the source goes on being transmitted to the whole of the heat supply pipe interior, whereby the methylene chloride solvent B inside the solvent tank 1*a* is heated to boil, forming a solvent vapor layer C. Then the solvent vapor infiltrates into the interior of the wood blocks to be treated 10 in the wood transport container 11, which are in the state of being left in said solvent vapor layer C. Then the free water not confined is thereby expelled out and the vapor melts the lignin which firmly blocks the cellulose and hemicellulose composing the cells of wood. This treatment work is continued for several hours. Then not only is the power switch for the heat supply pipe 4 turned OFF, but the methylene chloride solvent B inside the solvent tank 1*a*, which is no longer necessary for the latter half of the treatment work, is totally transferred into the solvent storage tank 7.

Figure 5:
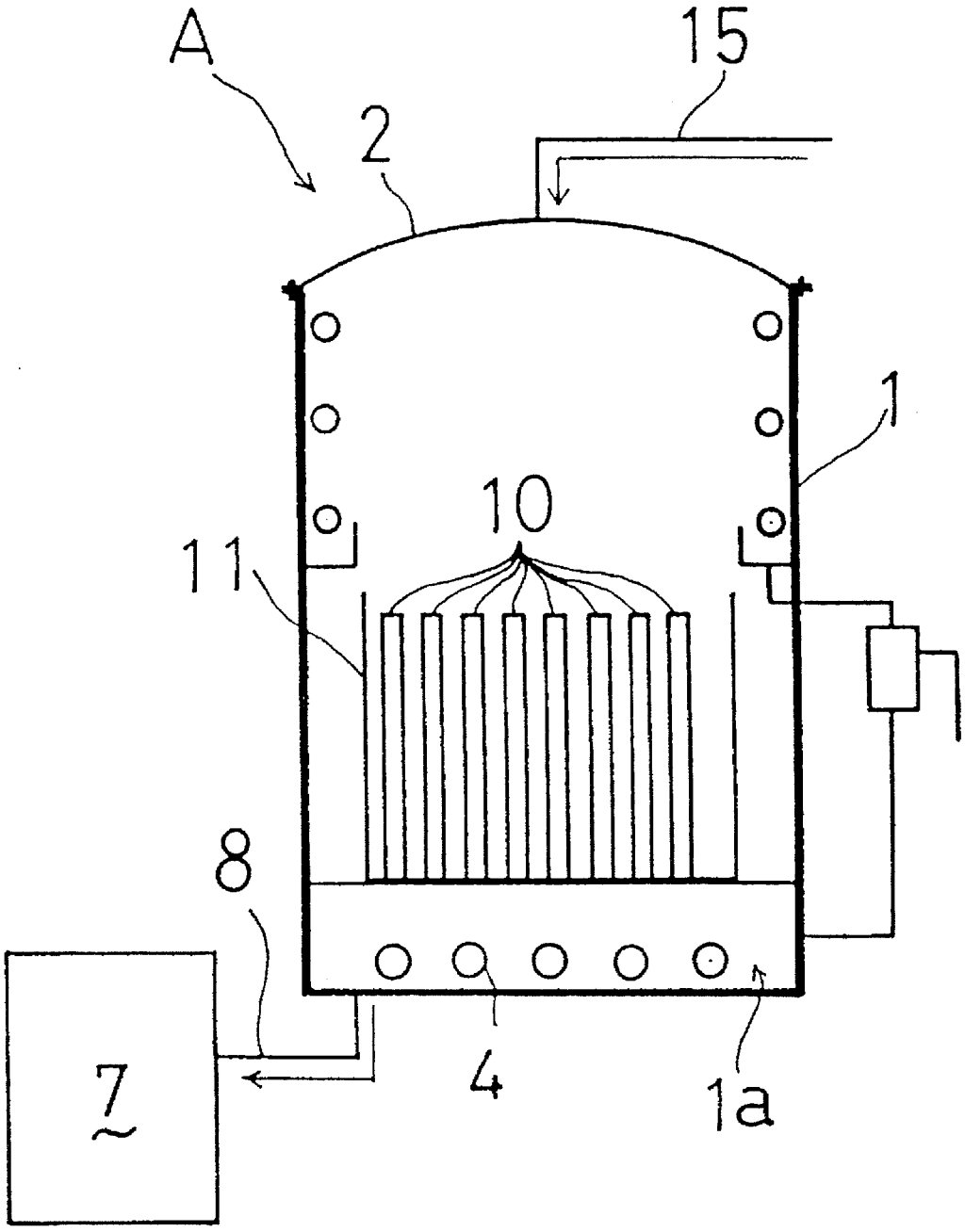
FIG. 5 is a schematic sectional view of the treating apparatus for use in exercising the wood treating method of this invention, showing the treating work by use thereof.

By the above-mentioned treatment, works are done of expelling the unconfined free water which is contained in the wood blocks to be treated 10 and of melting its oil and fat components, whereby the oil and fat components of wood are eluted by the methylene chloride ($CH_2Cl_2$) solvent B, together with its water content. As this defatting treatment has been accomplished, the oil and fat parts in the wood are dissolved out, bringing the wood into a state of its cells being perforated and the porthole valves being broken down. Next comes the work of reducing the water content to a predetermined value, as shown in FIG. 5.

In this operating example, the water content is reduced by hot air drying, but this may be done by sun's heat. In the case of hot air drying, the drying work of driving the water content out of the interior of the wood by means of hot air is carried out.

This drying work expells the solvent vapor which has infiltrated into the interior of the wood blocks to be treated 10 and drives out the confined free water through the perforated cells after oils and fats have been melted out and the porthole valve parts of the false vessels and vessels, etc. For this purpose, a hot air feed pipe 15 located on the top cover 2 is opened, to feed hot air into the interior of the wood treating pressure container A. By said hot air, the solvent and water content, which have infiltrated into the interior of the wood blocks to be treated 10, are evaporated and the free water, which has been confined inside the cells and in the false vessels and vessels, is also evaporated. By continuing this work for several hours, the solvent of methylene chloride and the confined free water can be completely evaporated from the interior of the treated wood blocks 10.

Figure 6:
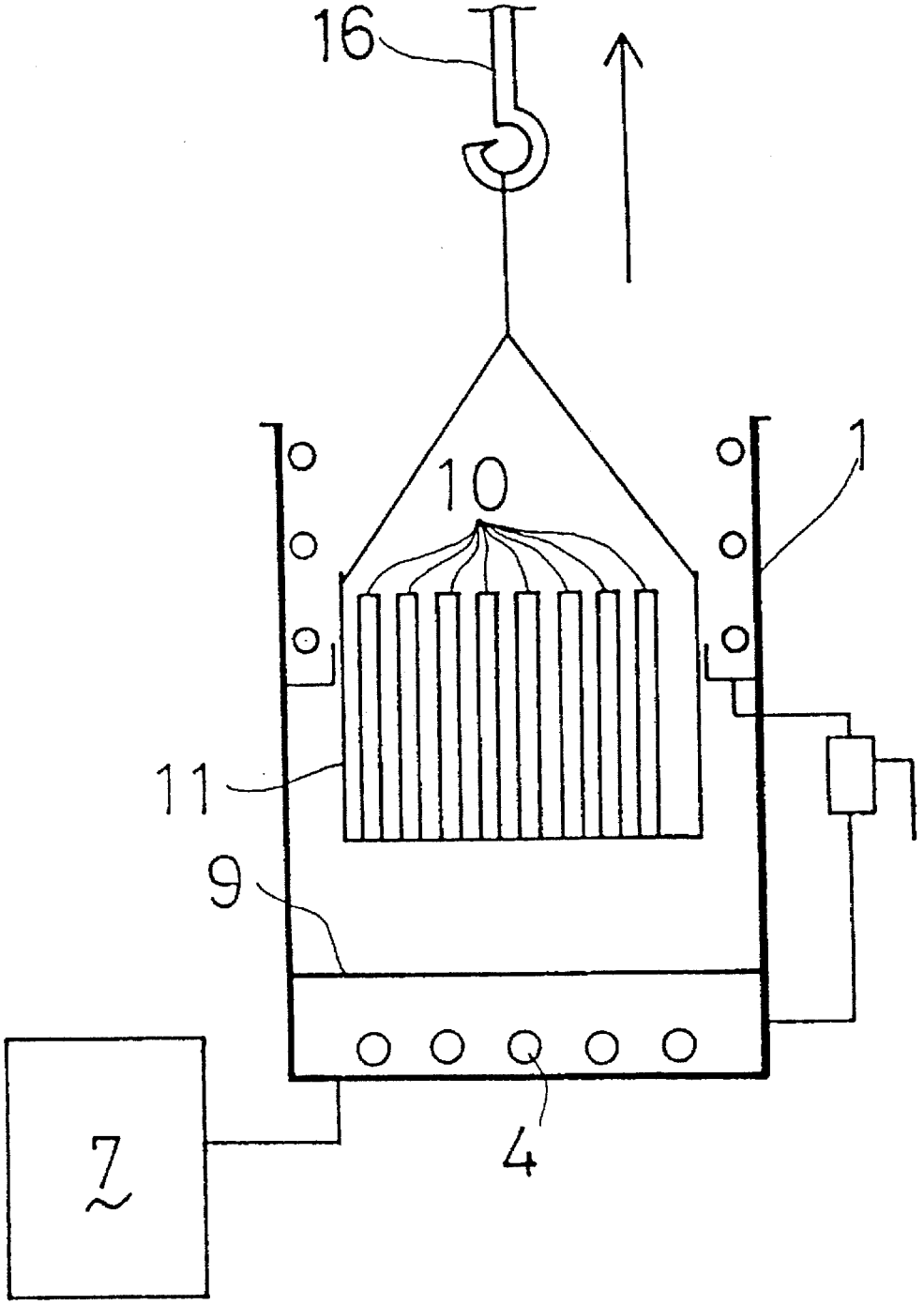
FIG. 6 is a schematic sectional view of the treating apparatus for use in exercising the wood treating method of this invention after accomplishment of the treating work by use thereof.

Upon completion of all treating works, the dome shape top cover 2 is again opened, as shown in FIG. 6, and then the wood transport container 11 is carried out of the wood treating pressure container A by means of a crane.

During the treating operation, as shown in FIG. 4, the solvent storage tank 7 is brought upward, to hold equal the level of the methylene chloride solvent B in the solvent tank 1*a* and the solvent storage tank 7, and upon completion of the first half of the treatment work, the solvent storage tank 7 is brought downward, to facilitate recovery of the methylene chloride solvent B in the solvent tank 1*a*. Then the solvent is recovered through a solvent drawing out pipe 8.

By this wood treating work, the wood is defatted by the methylene chloride solvent B, the tough lignin in the cell structure is melted, thereby perforating the cell membranes, and the porthole valves of the false vessels and vessels are broken down. In that way the process of driving out the confined free water through said perforations and porthole valves is facilitated. Thereafter, the coloring of the wood is made by infiltrating a fine grained dye through these perforations and portholes, etc. By the usual coloring method, the dye failed to penetrate into the interior of the wood because of its cells being firmly bound by lignin. In the method of this invention, as above-described, the methylene chloride solvent B melts out the tough lignin in the cell structure and undermines the portholes' valve action, to bring about a state which ensures easy fleeing of the confined water through said perforations and the porthole valves, thereby enabling coloring the wood with the same dye deep into its interior. The coloring operation with said dye may be performed by dipping in a dye bath the wood blocks which have been subjected to the defatting treatment, but it may also be permeated as a vapor, as above-described, with the fine grains of the dye mixed with the methylene chloride solvent B.

In the wood treating pressure container A of this invention, safety valves 17 and 18 are provided respectively on the top cover 2 and the solvent tank 1*a*, so that should an abnormal pressure develop in the interior of the wood treating pressure container A during the treating work, they would open to reduce the pressure, thereby keeping its inside pressure always constant. Besides, according to this invention, the methylene chloride solvent B and the wood blocks to be treated 10 are hermetically sealed in the interior of the wood treating pressure container A and heated by a heat supply pipe 4 or otherwise heated by some heat source from outside, thereby to vaporize the methylene chloride solvent B at a rate of about 6 kg/cm$^2$. The supply of heat to the heat supply pipe 4 is suspended about 1 hour later, to return the methylene chloride solvent B to its aqueous solution and the pressure is lowered to about the atmospheric pressure. The operation of compression by heating 1 hr later and decompression by cooling 1 hr later is repeated several times, whereby the defatting treatment by the vapor of the methylene chloride solvent B may be further promoted.

When the methylene chloride solvent B only is put in the solvent tank 1*a* inside the wood treating pressure container A and evaporated by heating, it may be vaporized at about 40° C., but because the surfaces of the wood blocks to be treated 10 are hardened at the initial period of the wood treatment, there arises a situation of penetration of methylene chloride solvent B into the cells being thwarted. To counter this situation, mixing about 90% of water with the methylene chloride solvent in the solvent tank 1*a* and then heating this mixture to 100°–140° C., thereby explosively vaporizing water and the methylene chloride solvent B, is effective.

Thus by mixing steam and vapor of methylene chloride and permeating the mixture into the wood blocks to be treated 10, the cells of said surfaces of the wood blocks to be treated 10 are opened and through the openings, the vapor of the methylene chloride solvent B is permeated, whereby the effect of promoting the defatting treatment is achieved When the wood blocks to be treated 10, after defatted by the methylene chloride solvent B, are dried, using hot air, their water content goes down to the equilibrium value in several hours, but even by drying them with sun's heat, it takes only about 2 weeks to reduce the water content to the equilibrium value.

As the defatting work of wood has ended with use of the methylene chloride ($CH_2Cl_2$) solvent and water, the methylene chloride ($CH_2Cl_2$) solvent and water again return to liquid, but besides them, the oil and fat contents in the wood also remain in this liquid in a separated state. Accordingly, the liquid is in the state of being separated in 3 layers of water, oil and fat components and methylene chloride. Then the oil and fat components of wood may be physically separated, from which to obtain a natural resin material.

Since the present invention is composed as hereabove described, following effects are achieved: The vapor of the methylene chloride ($CH_2Cl_2$) solvent B, a chlorine base organic solvent for cleaning by vapor-defatting, acts on the oil and fat components of wood, to defat and melt them, thereby partly perforating the cells of wood which are containing cell water and breaking down the porthole valves of the false vessels and vessels. In this way, fleeing of the free water contained therein which was hitherto difficult to extract and conversely penetration of dye are facilitated. Accordingly, this method drastically retrenches the wood treating time from one year unit to several days unit, as compared with the conventional method, thus enabling large amount of wood to be treated with enormous savings in time and energy.

The wood after treated, as compared with that before treated, has a volume that has been expanded, rather than shrunk, and its strength not reduced at all.

The methylene chloride solvent, a chlorine base organic solvent for cleaning by vapor-defatting which is used for large cutback on the treatment time is a highly safe chlorine base solvent which does not injure wood and moreover has such a low B.P. as 40° C., so that even when feeding hot air into the interior of the wood treating apparatus as a finishing step of the treatment work or when recovering it by distillation, the time and energy may be saved.

According to this invention, a fine grained dye is mixed with methylene chloride or loaded on the gas of methylene chloride, for said fine grained dye to be carried into the cells of wood. In this way, it has become possible to obtain a wood with a nearly uniform grain color. In the conventional coloring method, wood is colored by dipping in a bath of a molten dye, but the cell's defence is firm, with the wood's lignin remaining unmelted, thus permitting the dye to penetrate only to the surface, resulting in this colored layer. Therefore, if the surface of the wood was shaved or otherwise removed, the colored layer was stripped, exposing the former wood grain deprived of the effect of coloration. However, when as in the method of this invention, the wood is dyed, after defatting it with use of the methylene chloride solvent, a chlorine base organic solvent for cleaning by vapor-defatting, the coloration can be made deeper by letting the fine grained dye penetrate into the cells, thereby enabling the colored layer to be left unremoved, even if the surface is shaved.

In this invention, "wood" contains "chip" for pulp industry.

I claim:

1. A wood treating method, comprising the following steps of:

providing a mixture of methylene chloride solvent and water in a container, said water accounting for approximately 90% of said mixture;

heating said mixture in said container at approximately 100° C.–140° C. so that vapors of said methylene chloride solvent and said water are simultaneously generated;

confining wood to be treated and said vapor of said mixture in a pressure container which is hermetically sealed with respect to an outer atmosphere so that said wood contacts solely with said vapor of said mixture;

permeating said vapor of said mixture into cells of said wood;

melting oil and fat contents in cell membranes of said cells by said vapor thereby creating perforations in said cell membranes; and removing excess water confined in said cells of said wood through said perforations in said cell membranes.

2. A wood treating method as defined in claim 1 further including the step of:

repeatedly subjecting said wood to be treated to compressed vapor of said mixture and decompressed vapor of said mixture, wherein said repeatedly subjecting process comprises;

heating the mixture of said water and said methylene chloride to about 100° C.–140° C. thereby increasing the pressure of said vapor of said mixture to create said compressed vapor of said mixture;

suspending the operation of heating said mixture to create said decompressed vapor of said mixture.

3. A wood treating method as defined in claim 1 further including the step of drying the wood which has been treated.

4. A wood treating method as defined in claim 1 further including the step of coloring the wood which has been treated by permeating a fine grained color material into the wood.

* * * * *